US009325097B2

(12) United States Patent
Do

(10) Patent No.: US 9,325,097 B2
(45) Date of Patent: Apr. 26, 2016

(54) CONNECTOR CONTACTS WITH THERMALLY CONDUCTIVE POLYMER

(71) Applicant: Apple Inc., Cupertino, CA (US)

(72) Inventor: Trent K. Do, Milpitas, CA (US)

(73) Assignee: APPLE INC., Cupertino, CA (US)

( * ) Notice: Subject to any disclaimer, the term of this patent is extended or adjusted under 35 U.S.C. 154(b) by 413 days.

(21) Appl. No.: 13/679,036

(22) Filed: Nov. 16, 2012

(65) Prior Publication Data

US 2014/0141647 A1 May 22, 2014

(51) Int. Cl.
*H01R 13/405* (2006.01)
*H01R 43/24* (2006.01)
*H01R 13/6594* (2011.01)

(52) U.S. Cl.
CPC ..... *H01R 13/405* (2013.01); *H01R 13/6594* (2013.01); *H01R 43/24* (2013.01); *Y10T 29/49222* (2015.01)

(58) Field of Classification Search
CPC ..... H01R 13/405; H01R 43/20; H01R 43/24; H01R 13/6594; Y10T 29/49222
USPC ..... 439/931, 886, 607.02, 606, 733.1
See application file for complete search history.

(56) References Cited

U.S. PATENT DOCUMENTS

| | | | | |
|---|---|---|---|---|
| 2,380,994 | A | | 8/1945 | Pummill |
| 2,564,029 | A | | 8/1951 | Petersen |
| 2,564,550 | A | | 8/1951 | Tichenor |
| 2,792,557 | A | | 5/1957 | Dowick |
| 2,892,990 | A | | 6/1959 | Werndl |
| 3,760,335 | A | | 9/1973 | Roberts |
| 3,793,614 | A | | 2/1974 | Tachick et al. |
| 3,795,037 | A | | 3/1974 | Luttmer |
| 4,361,375 | A | | 11/1982 | Bailey et al. |
| 4,558,912 | A | | 12/1985 | Coller et al. |
| 4,621,882 | A | | 11/1986 | Krumme |
| 4,711,506 | A | | 12/1987 | Tanaka |
| 4,969,842 | A | * | 11/1990 | Davis ..... 439/629 |
| 5,028,492 | A | * | 7/1991 | Guenin ..... 428/614 |
| 5,040,994 | A | | 8/1991 | Nakamoto et al. |
| 5,256,074 | A | | 10/1993 | Tan et al. |
| 5,295,843 | A | | 3/1994 | Davis et al. |
| 5,380,179 | A | | 1/1995 | Nishimura et al. |

(Continued)

FOREIGN PATENT DOCUMENTS

| | | |
|---|---|---|
| CN | 1397804 | 2/2003 |
| CN | 1830122 A | 9/2006 |

(Continued)

OTHER PUBLICATIONS

Flipper Press Release (Jun. 25, 2012) and Data Sheet: http://www.flipperusb.com/images/flipperUSB-brochure.pdf.

(Continued)

*Primary Examiner* — Briggitte R Hammond
(74) *Attorney, Agent, or Firm* — Kilpatrick Townsend & Stockton LLP

(57) ABSTRACT

An improved electronic receptacle connector employs contacts that are partially encapsulated with a thermally conductive polymer. The thermally conductive polymer aids in the distribution of heat within the contact and may further form heat transfer features to conduct heat to other connector components such as the shell. The thermally conductive polymer may be used to encapsulate multiple contacts within a substantially unitary block.

20 Claims, 8 Drawing Sheets

(56) References Cited

U.S. PATENT DOCUMENTS 5,380,225 A 1/1995 Inaoka
5,387,110 A 2/1995 Kantner et al.
5,413,442 A 5/1995 Grey
5,442,243 A 8/1995 Bailey
5,509,823 A * 4/1996 Harting et al. ..... 439/607.17
5,518,421 A 5/1996 Davis
5,554,042 A 9/1996 Denninger
5,594,284 A 1/1997 Hill et al.
5,785,557 A 7/1998 Davis
5,934,942 A * 8/1999 Patel et al. ..... 439/607.5
5,957,736 A * 9/1999 Moriuchi et al. ..... 439/876
5,959,848 A 9/1999 Groves et al.
5,967,723 A 10/1999 Duran
5,967,833 A 10/1999 Cachina
6,074,225 A 6/2000 Wu et al.
6,086,421 A 7/2000 Wu et al.
6,113,427 A 9/2000 Wu
6,179,627 B1 1/2001 Daly et al.
6,200,171 B1 * 3/2001 Fusselman et al. ..... 439/736
6,203,387 B1 * 3/2001 Daly et al. ..... 439/886
6,231,396 B1 5/2001 Huang
6,322,394 B1 11/2001 Katoh et al.
6,364,699 B1 4/2002 Hwang et al.
6,410,857 B1 6/2002 Gonya
6,478,586 B1 * 11/2002 Ma ..... 439/79
6,482,028 B2 11/2002 Kumamoto et al.
6,482,045 B2 11/2002 Arai
6,488,520 B1 12/2002 Hayes et al.
6,530,793 B2 3/2003 Eichhorn et al.
6,537,091 B2 * 3/2003 Hirai et al. ..... 439/181
6,692,311 B1 2/2004 Kamei et al.
6,716,058 B2 4/2004 Youn
6,776,665 B2 8/2004 Huang
6,786,763 B2 9/2004 Wu
6,846,202 B1 1/2005 Schmidt et al.
6,869,320 B2 3/2005 Haas et al.
6,902,432 B2 6/2005 Morikawa et al.
6,948,965 B2 9/2005 Kumamoto et al.
6,948,983 B1 9/2005 Peng
6,948,984 B2 9/2005 Chen et al.
6,962,510 B1 11/2005 Chen et al.
6,964,582 B2 11/2005 Zhuang et al.
6,981,887 B1 1/2006 Mese et al.
6,994,575 B1 2/2006 Clark et al.
7,021,971 B2 4/2006 Chou et al.
7,040,919 B2 5/2006 Yao
7,074,052 B1 7/2006 Ni et al.
7,094,086 B2 8/2006 Teicher
7,094,089 B2 8/2006 Andre et al.
7,094,117 B2 * 8/2006 Farnworth et al. ..... 439/886
7,160,125 B1 1/2007 Teicher
7,175,444 B2 2/2007 Lang et al.
7,192,313 B2 3/2007 Sai
7,198,522 B1 4/2007 Ho et al.
7,249,974 B2 * 7/2007 Gordon et al. ..... 439/607.41
7,249,978 B1 7/2007 Ni
7,361,059 B2 4/2008 Harkabi et al.
7,363,947 B2 4/2008 Teicher
7,364,445 B1 4/2008 Ni et al.
7,387,539 B2 6/2008 Trenne
7,396,257 B2 7/2008 Takahashi
7,407,416 B1 8/2008 Rogers et al.
7,435,107 B2 10/2008 Masumoto et al.
7,440,286 B2 10/2008 Hiew et al.
7,442,091 B2 10/2008 Salolmon et al.
7,458,825 B2 12/2008 Atsmon et al.
7,500,861 B2 3/2009 Harkabi et al.
7,537,471 B2 5/2009 Teicher
7,549,896 B2 6/2009 Zhang et al.
7,553,172 B2 6/2009 Chiu et al.
7,559,805 B1 7/2009 Yi et al.
7,572,146 B1 * 8/2009 Chiang ..... 439/607.01
7,572,153 B2 8/2009 Trenne
7,591,657 B2 9/2009 Teicher
7,594,827 B2 9/2009 Takamoto et al.
7,695,318 B1 4/2010 Wang et al.
7,716,400 B2 5/2010 Raines
7,717,717 B1 5/2010 Lai
7,722,409 B2 5/2010 Takamoto et al.
7,727,027 B2 6/2010 Chiang et al.
7,740,498 B1 6/2010 Orsley
7,841,894 B2 11/2010 Gong et al.
7,865,629 B1 1/2011 Tantos et al.
7,872,873 B2 1/2011 Hiew et al.
7,892,014 B2 2/2011 Amidon et al.
7,918,685 B1 4/2011 Kruckenberg
8,007,309 B2 8/2011 Fan
8,062,073 B1 11/2011 Szczesny et al.
8,162,696 B2 4/2012 Elbaz et al.
8,246,388 B2 8/2012 Chen et al.
8,277,258 B1 10/2012 Huang et al.
8,282,417 B2 10/2012 Xiao
8,287,299 B2 10/2012 Ray et al.
8,342,863 B2 1/2013 Kondo et al.
8,461,465 B2 6/2013 Golko et al.
8,478,913 B2 7/2013 Terlizzi et al.
8,517,751 B1 8/2013 Golko et al.
8,517,766 B2 8/2013 Golko et al.
8,535,075 B1 9/2013 Golko et al.
8,545,269 B2 10/2013 Ore-Yang
8,545,275 B2 10/2013 Wang et al.
8,561,879 B2 10/2013 Jol et al.
8,573,995 B2 11/2013 Golko et al.
8,647,156 B2 2/2014 Golko et al.
8,686,600 B2 4/2014 Terlizzi et al.
8,688,876 B1 4/2014 Fritchman et al.
8,708,745 B2 4/2014 Golko et al.
8,762,605 B2 6/2014 Terlizzi et al.
8,777,666 B2 7/2014 Golko et al.
8,882,524 B2 11/2014 Golko et al.
8,911,260 B2 12/2014 Golko et al.
8,931,962 B2 1/2015 Jol et al.
8,998,632 B2 4/2015 Golko et al.
2001/0046809 A1 11/2001 Chiran et al.
2002/0081880 A1 6/2002 Eichhorn et al.
2003/0012677 A1 1/2003 Senini
2003/0016509 A1 1/2003 Tsukamoto
2003/0060065 A1 * 3/2003 Harper et al. ..... 439/83
2003/0207606 A1 11/2003 Ho
2004/0229515 A1 11/2004 Kaneda et al.
2004/0259423 A1 12/2004 Elbaz et al.
2005/0032426 A1 2/2005 Tanaka
2005/0042930 A1 2/2005 Harkabi et al.
2005/0079738 A1 4/2005 Ahn
2005/0085136 A1 4/2005 Zhang
2005/0124217 A1 6/2005 Zhuang et al.
2005/0124218 A1 6/2005 Chen et al.
2005/0124219 A1 6/2005 Chen et al.
2005/0202727 A1 9/2005 Andre et al.
2006/0019545 A1 1/2006 Moriyama et al.
2006/0024997 A1 2/2006 Teicher
2006/0040549 A1 2/2006 Yao
2006/0148300 A1 7/2006 Huang et al.
2006/0216991 A1 9/2006 Boutros
2006/0228948 A1 * 10/2006 Swain et al. ..... 439/660
2006/0250764 A1 11/2006 Howarth et al.
2006/0289201 A1 12/2006 Kim et al.
2007/0010115 A1 1/2007 Teicher
2007/0010116 A1 1/2007 Teicher
2007/0037452 A1 2/2007 Martin et al.
2007/0049100 A1 3/2007 Tsai
2007/0072442 A1 3/2007 DiFonzo
2007/0082701 A1 4/2007 Seil et al.
2007/0178771 A1 8/2007 Goetz et al.
2007/0202725 A1 8/2007 Teicher
2007/0243726 A1 10/2007 Trenne
2008/0032562 A1 2/2008 McHugh et al.
2008/0067248 A1 3/2008 Hiew et al.
2008/0090465 A1 4/2008 Matsumoto et al.
2008/0119076 A1 5/2008 Teicher
2008/0119291 A1 5/2008 Takamoto et al.
2008/0167828 A1 7/2008 Terlizzi et al.
2008/0200069 A1 8/2008 Hankey et al.
2008/0274633 A1 11/2008 Teicher

(56) References Cited

U.S. PATENT DOCUMENTS

| | | | | |
|---|---|---|---|---|
| 2008/0309313 | A1 | 12/2008 | Farrar et al. | |
| 2009/0004923 | A1 | 1/2009 | Tang et al. | |
| 2009/0068887 | A1* | 3/2009 | Ito | 439/608 |
| 2009/0108848 | A1 | 4/2009 | Lundquist | |
| 2009/0117768 | A1 | 5/2009 | Liao | |
| 2009/0149049 | A1 | 6/2009 | Harkabi et al. | |
| 2009/0156027 | A1 | 6/2009 | Chen | |
| 2009/0180243 | A1 | 7/2009 | Lynch et al. | |
| 2009/0291576 | A1 | 11/2009 | Johansson et al. | |
| 2010/0009575 | A1 | 1/2010 | Crooijmans et al. | |
| 2010/0062656 | A1 | 3/2010 | Lynch et al. | |
| 2010/0080563 | A1 | 4/2010 | DiFonzo et al. | |
| 2010/0104126 | A1 | 4/2010 | Greene | |
| 2010/0118932 | A1 | 5/2010 | Luo et al. | |
| 2010/0144172 | A1* | 6/2010 | Pavlovic | 439/78 |
| 2010/0171465 | A1 | 7/2010 | Seal et al. | |
| 2010/0173533 | A1 | 7/2010 | Yang et al. | |
| 2010/0221936 | A1 | 9/2010 | Zhao et al. | |
| 2010/0248544 | A1 | 9/2010 | Xu et al. | |
| 2010/0254602 | A1 | 10/2010 | Yoshino | |
| 2010/0254662 | A1 | 10/2010 | He et al. | |
| 2010/0262744 | A1 | 10/2010 | Deva et al. | |
| 2010/0267261 | A1 | 10/2010 | Lin et al. | |
| 2010/0267262 | A1 | 10/2010 | Lin et al. | |
| 2011/0136381 | A1 | 6/2011 | Cho | |
| 2011/0159719 | A1 | 6/2011 | Takahashi et al. | |
| 2011/0201213 | A1 | 8/2011 | Dabov et al. | |
| 2011/0250786 | A1 | 10/2011 | Reid | |
| 2011/0263141 | A1 | 10/2011 | Ko | |
| 2011/0294354 | A1 | 12/2011 | Chen et al. | |
| 2011/0312200 | A1 | 12/2011 | Wang et al. | |
| 2012/0028495 | A1 | 2/2012 | Su et al. | |
| 2012/0149244 | A1 | 6/2012 | Zheng et al. | |
| 2013/0075149 | A1 | 3/2013 | Golko et al. | |
| 2013/0078869 | A1 | 3/2013 | Golko et al. | |
| 2013/0089291 | A1 | 4/2013 | Jol et al. | |
| 2013/0095701 | A1 | 4/2013 | Golko et al. | |
| 2013/0095702 | A1 | 4/2013 | Golko et al. | |
| 2013/0115821 | A1 | 5/2013 | Golko et al. | |
| 2013/0117470 | A1 | 5/2013 | Terlizzi et al. | |
| 2013/0122754 | A1 | 5/2013 | Golko et al. | |
| 2013/0149911 | A1 | 6/2013 | Golko et al. | |
| 2013/0217253 | A1 | 8/2013 | Golko et al. | |
| 2013/0244489 | A1 | 9/2013 | Terlizzi et al. | |
| 2013/0244491 | A1 | 9/2013 | Sarwar et al. | |
| 2013/0244492 | A1 | 9/2013 | Golko et al. | |
| 2013/0337698 | A1 | 12/2013 | Little et al. | |
| 2014/0004741 | A1 | 1/2014 | Jol et al. | |
| 2014/0057496 | A1 | 2/2014 | Siahaan et al. | |
| 2014/0068933 | A1 | 3/2014 | Brickner et al. | |
| 2014/0069709 | A1 | 3/2014 | Schmidt et al. | |
| 2014/0073170 | A1 | 3/2014 | Golko et al. | |
| 2014/0073183 | A1 | 3/2014 | Golko et al. | |
| 2014/0073193 | A1 | 3/2014 | SooHoo et al. | |
| 2014/0141647 | A1* | 5/2014 | Do | 439/606 |
| 2014/0170907 | A1 | 6/2014 | Golko et al. | |
| 2014/0294656 | A1 | 10/2014 | Brickner et al. | |
| 2014/0329416 | A1 | 11/2014 | Golko et al. | |

FOREIGN PATENT DOCUMENTS

| | | | |
|---|---|---|---|
| CN | 1905286 | A | 1/2007 |
| CN | 101116227 | A | 1/2008 |
| CN | 201256225 | Y | 6/2009 |
| CN | 201402871 | Y | 2/2010 |
| CN | 201509210 | U | 6/2010 |
| CN | 101782888 | A | 7/2010 |
| CN | 101783466 | A | 7/2010 |
| CN | 201533091 | U | 7/2010 |
| DE | 19609571 | A1 | 11/1995 |
| DE | 202004021354 | U1 | 9/2007 |
| EP | 0081372 | A2 | 6/1983 |
| EP | 1684391 | A2 | 7/2006 |
| EP | 1717910 | A2 | 11/2006 |
| EP | 2169774 | A1 | 3/2010 |
| EP | 2373131 | A1 | 10/2011 |
| JP | 2078171 | A | 3/1990 |
| JP | H06231821 | A | 8/1994 |
| JP | H06250103 | A | 9/1994 |
| JP | 8321360 | A | 12/1996 |
| JP | 2001223057 | A | 8/2001 |
| JP | 2003217728 | A | 7/2003 |
| JP | 2004079491 | A | 3/2004 |
| JP | 2004319371 | A | 11/2004 |
| JP | 2008041656 | A | 2/2008 |
| JP | 2008508694 | A | 3/2008 |
| JP | 2008210674 | A | 9/2008 |
| JP | 2009117128 | A | 5/2009 |
| JP | 2010067459 | A | 3/2010 |
| TW | M318831 | U | 9/2007 |
| TW | M350153 | U | 2/2009 |
| WO | 0208872 | A1 | 1/2002 |
| WO | 2004097995 | A1 | 11/2004 |
| WO | 2005013436 | A1 | 2/2005 |
| WO | 2005124932 | A2 | 12/2005 |
| WO | 2006013553 | A2 | 2/2006 |
| WO | 2006074348 | A1 | 12/2006 |
| WO | 2007090069 | | 8/2007 |
| WO | 2008065659 | A2 | 6/2008 |
| WO | 2009069969 | A2 | 6/2009 |
| WO | 2009140992 | A1 | 11/2009 |
| WO | 2011043488 | A1 | 4/2011 |
| WO | 2012086145 | A1 | 6/2012 |

OTHER PUBLICATIONS

Hewlett-Packard Company, "An Overview of Current Display Interfaces," Nov. 2007, p. 12, http://isvpatch.external.hp.com/HPPTF2/drvlib/docs/DisplayInterfacesOverview.pdf, 14 pages.

* cited by examiner

CONNECTOR CONTACTS WITH THERMALLY CONDUCTIVE POLYMER

BACKGROUND OF THE INVENTION

The present invention relates generally to electrical connectors and in particular to electrical connectors that are mounted to a printed circuit board (PCB) within an electronic device. A wide variety of electronic devices are available for consumers today. Many of these devices have connectors that that facilitate communication with and/or charging of a corresponding device. These connectors often interface with other connectors through cables that are used to connect devices to one another. Sometimes, connectors are used without a cable to directly connect the device to another device, such as in a docking station or a sound system.

As an example, receptacle connectors are sometimes positioned on one or more of the surfaces of an electronic device and are mounted to a printed circuit board within the device. As smart-phones, media players, charging stations and other electronic devices become more indispensable to their operators, the reduction of charging time becomes increasingly important. As many of these devices are charged through the receptacle connectors, this may require the receptacle connectors to be able to handle increased electrical current.

Thus, new connectors may require new features and/or changes to commonly used connectors to be able to meet the higher electrical current capacity required by electronic devices.

BRIEF SUMMARY OF THE INVENTION

Embodiments of the invention pertain to technology that is particularly useful in the manufacture of electronic connectors. Some embodiments relate to the formation of electronic connectors that may be installed in an electronic device. The electronic device may require a high electrical current to be conducted through the receptacle connector. One or more individual contacts within the connector may be partially encapsulated with a thermally conductive polymer. In some embodiments the contacts include a tip connected by a beam portion to an anchor portion and a portion of the beam portion is encapsulated with a thermally conductive polymer. In other embodiments, other portions of the contacts may be encapsulated with a thermally conductive polymer.

Some embodiments of the contacts may employ heat transfer features made from thermally conductive polymer. These features may be used to transfer heat out of the contact to other connector components such as the housing or the shell. In further embodiments, the heat transfer features may be made from both metal and a thermally conductive polymer. In some embodiments, the thermally conductive polymer may be electrically conductive, while in other embodiments the polymer may be electrically insulative.

Some embodiments may encapsulate more than one contact in a substantially unitary block of thermally conductive polymer. Further embodiments may have one or more adjacent contacts encapsulated with thermally conductive polymer and one or more ground structures extending from the housing, disposed between adjacent contacts.

To better understand the nature and advantages of the present invention, reference should be made to the following description and the accompanying figures. It is to be understood, however, that each of the figures is provided for the purpose of illustration only and is not intended as a definition of the limits of the scope of the present invention.

DETAILED DESCRIPTION OF THE INVENTION

Certain embodiments of the present invention relate to electrical connectors that are assembled to PCBs or another type of substrate that may be employed in an electronic device. While the present invention can be useful to produce connector assemblies for a wide variety of electronic devices, some embodiments of the invention are particularly useful for producing connector assemblies for electronic devices that require high electrical current capacity and/or reduced connector operating temperatures, as described in more detail below.

Figure 1:
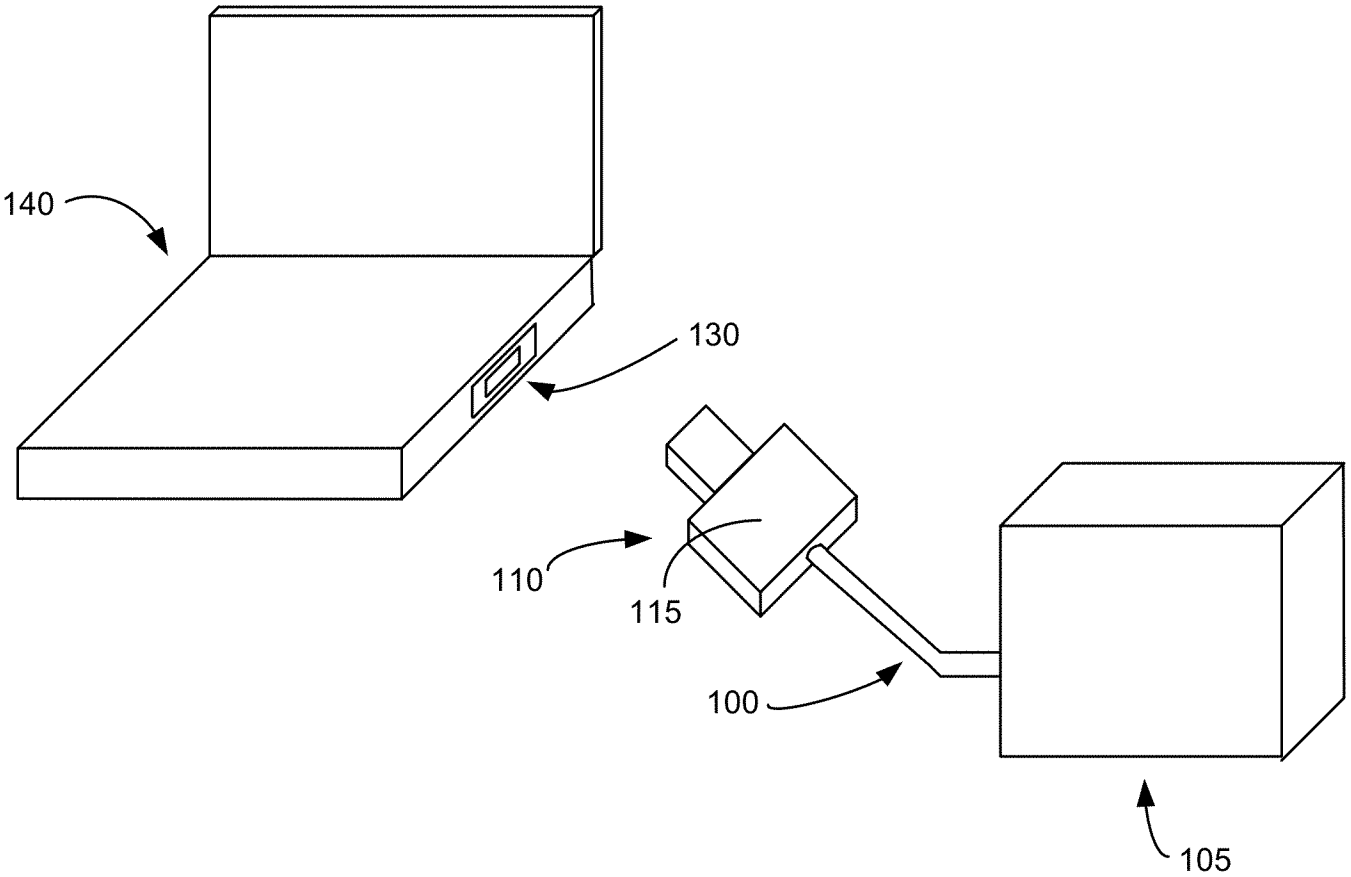
FIG. 1 is a diagram that illustrates an example of an electronic device and a peripheral device employing a receptacle connector and a connector plug, respectively.

Certain embodiments of the present invention relate to electrical connectors employed in electronic devices. Many electronic devices such as smart-phones, media players, and tablet computers have electronic connectors that facilitate battery charging and/or communication with other devices. The connectors include a plurality of electrical contacts through which electrical connections are made to another compatible connector to transfer power and/or data signals through the connectors. FIG. 1 illustrates an example of two such connectors including a plug connector 110 and a receptacle connector 130. Each of these connectors 110, 130 may comply with a well-known standard such as Universal Serial Bus (USB) 2.0, Firewire, Thunderbolt, or the like or may be proprietary connectors, such as the 30-pin connector used on many Apple products among other types of proprietary connectors.

As further shown in FIG. 1, plug connector 110 can be coupled to a cable 100, which in turn can be coupled to a peripheral device 105 that can be any of many different electronic devices or accessories that operate with such devices. Receptacle connector 130 can be incorporated into a computing device 140, such as a desktop or laptop computer, or another type of electronic device. When the plug connector 110 is mated with the receptacle 130, electrical contacts within each electronic connector (not shown in FIG. 1) are in physical and electrical contact with each other to allow electrical signals to be transferred between device 140 and device 105.

To further illustrate embodiments of the invention, various examples of electrical connectors that include high current capacity and/or reduced operating temperatures that may be made in accordance with the present invention are discussed below, however these embodiments should in no way limit the applicability of the invention to other connectors.

Figure 2A:
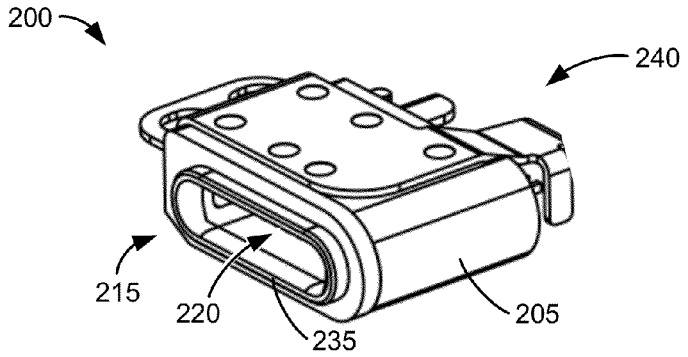
FIG. 2A is a diagram that illustrates a front perspective view of an electrical receptacle connector with contacts comprising a thermally conductive polymer in accordance with an embodiment of the invention.

FIG. 2A is a simplified perspective view of the front and top surfaces of an exemplary receptacle connector assembly 200 in accordance with one embodiment of the invention. Connector assembly 200 may include a body that defines a cavity 220 for receiving a plug portion of a mating connector (not shown). In the embodiment shown in FIG. 2A, the body is made from a shell 205 and an inner housing 245. Shell 205 may comprise, for example, metal, an electrically and/or thermally conductive polymer, or a combination thereof, as described in more detail below. Connector assembly 200 may have a receiving face 215 that may comprise an aperture defined by perimeter 235, and may be aligned with cavity 220. In some embodiments the dimensions of receptacle connector assembly 200 are less than 40 mm long by 40 mm wide by 8 mm thick. In other embodiments the dimensions of receptacle connector assembly 200 are less than 30 mm long by 30 mm wide by 7 mm thick. In further embodiments the dimensions of receptacle connector assembly 200 are less than 20 mm long by 20 mm wide by 6 mm thick. Also, in some embodiments, the width of aperture 237 is at least three times as long as the height of aperture 237.

Figure 2B:
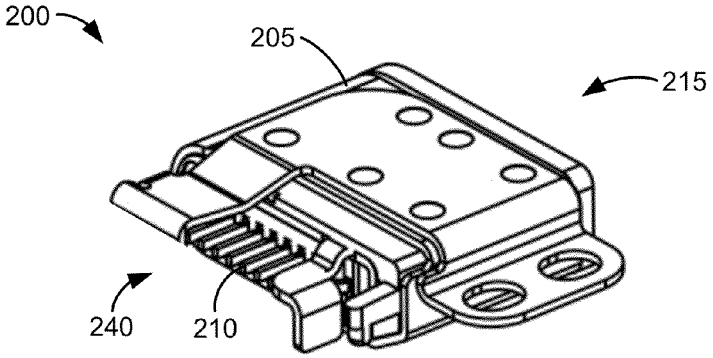
FIG. 2B is a diagram that illustrates a rear perspective view of an electrical receptacle connector with contacts comprising a thermally conductive polymer in accordance with an embodiment of the invention.

A simplified perspective view of the rear and top surfaces of connector assembly 200 is shown in FIG. 2B. Connector assembly 200 may have a rear face 240 disposed opposite receiving face 215. Rear face 240 may have a plurality of electrical leads 210 protruding from contact structures (see FIG. 2C) disposed within connector assembly 200.

Figure 2C:
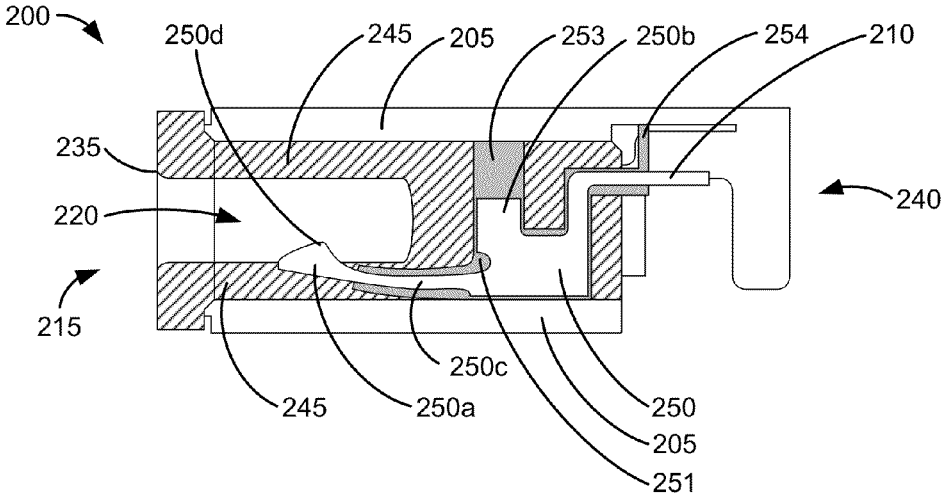
FIG. 2C is a diagram that illustrates a cross-sectional view of an electrical receptacle connector with contacts comprising a thermally conductive polymer in accordance with an embodiment of the invention.

The internal construction of one embodiment of connector assembly 200 is shown in more detail in FIG. 2C. This figure illustrates a cross-sectional view of connector assembly 200. In this embodiment there may be a housing 245 disposed at least partially within shell 205. Housing 245 may comprise an electrically insulative material, such as, for example, plastic. Housing 245 may extend between receiving face 215 and rear face 240. Further, housing 245 may define cavity 220 that communicates with the front opening defined by perimeter 235.

Connector assembly 200 may include a plurality of contacts 250, one or more of which may be partially encapsulated with a thermally conductive polymer 251. Each of contacts 250 may include a contact tip 250*a*, an anchor 250*b* and a beam portion 250*c* that extends between the tip and the anchor. The tip 250*a* of each individual contact is positioned within cavity 220 to electrically couple the contact to a mating contact in a corresponding plug connector during a mating event. The plurality of contacts 250 may be arranged in a single row with tip 250*d* of each contact at the same depth within housing 245. Beam portion 250*c* allows the tip of each contact 250 to flex slightly downward during the mating event and biases contact tip 250*a* to keep physical and electrical contact with a contact in the plug connector that aligns with the particular receptacle contact. Anchor portion 250*b* of contact 250 may be a substantially flat plate with one or more cutouts that fits within a slot (not shown) of housing 245 to secure or anchor contacts 250 in place. Contacts 250 may further include electrical leads 210 that extend out of rear face 240 of connector assembly 200 that can couple the receptacle connector to a printed circuit board or similar substrate in an electronic device the receptacle connector is part of.

Each contact 250 may be made from, for example, brass, copper, steel or any other electrically conductive material. In some embodiments, beam portion 250*c* and anchor portion 250*b* may be over-molded with a thermally conductive polymer 251 to help distribute or conduct thermal energy away from contact 250, as explained in more detail below.

In some embodiments, one or more of contacts 250 may be employed to pass electrical current between tip 250*a* and lead 210. The passage of electrical current through contact 250 may generate heat. More specifically, heat may be generated at contact surface 250*d* of tip 250*a* due to contact resistance between contact 250 and mating connector (not shown). Heat may also be generated within contact 250 according to the electrical resistance of the material used for contact 250. The generation of heat in contact surface 250*d* and contact 250 typically increases proportional to the square of the current according to the equation:

$$P=I^2R$$

where:

P=Power generation in Watts

I=Current in Amps

R=Contact resistance or resistance of contact material in Ohms

Thus, as more current is passed through contact 250 the power generated within contact surface 250*d* and contact 250 increases exponentially. The generation of thermal power manifests itself as an increase in temperature of contact surface 250*d* and contact 250. In some embodiments, it may be desirable to maintain the temperature of contact surface 250*d* and contact 250 below a maximum temperature. To help achieve this, some embodiments may judiciously include thermally conductive polymer 251 as a portion of contact 250 to distribute thermal energy and/or conduct it away from contact surface 250*d* and contact 250.

More specifically, to remove heat from contact surface 250*d*, thermally conductive polymer 251 may be employed on the beam portion 250*c* of contact 250. Thermally conductive polymer 251 may be used to increase the cross-sectional area of beam portion 250*c*, allowing thermal energy to be more efficiently conducted towards anchor portion 250*b* of contact 250 according to Fourier's Unidirectional Law of Heat Conduction which is:

$$q=-kA(dT/dx)$$

where:

q=Rate of heat conduction k=Thermal conductivity of the material

A=Cross-sectional area through which the heat is being conducted dT=Temperature difference between the points the heat is being conducted between dx=Distance between the points the heat is being conducted between Thus, the approximate rate of heat conduction from contact surface 250*d* to anchor portion 250*b* is proportional to the cross-sectional area of beam portion 250*c* and the thermal conductivity of the contact 250 and the thermally conductive polymer 251. Thus, the addition of thermally conductive polymer 251 to beam portion 250*c* may result in more efficient heat transfer from contact surface 250*d* to anchor portion 250*b*, thereby reducing the temperature of the contact surface.

Similar improvements can be made to conduct heat from anchor portion 250*b* to shell 205. Some embodiments of contacts 250 may form thermal features 253, 254 from thermally conductive polymer 251 so heat can be conducted from contact 250 to shell 205 and/or housing 245. Shell 205 may further be thermally and/or electrically coupled to the PCB or the electronic device, which may improve the ability of shell 205 to dissipate heat generated by contact surface 250*d* and contact 250. In some embodiments, shell 205 may be electrically connected to ground, which may act as a thermal conduction path to aid in the dissipation of heat.

Figure 3:
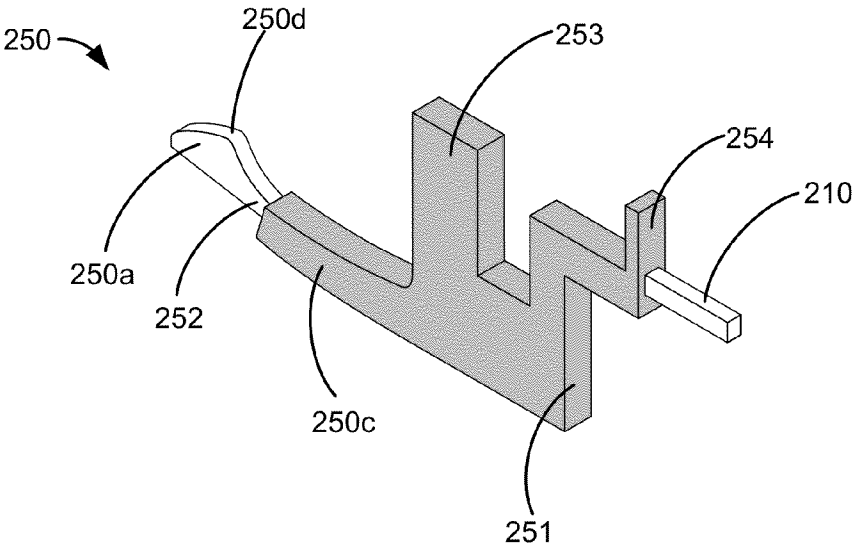
FIG. 3 is a diagram of an embodiment that illustrates a perspective view of a contact comprising a thermally conductive polymer in accordance with an embodiment of the invention.

These features are shown in greater detail in FIG. 3 which illustrates one embodiment of contact 250 in an isometric view. As illustrated, some embodiments may have the beam portion 250*c* as well as the anchor portion 250*b* at least partially encapsulated with thermally conductive polymer 251. Thermally conductive polymer 251 may approximately match the general shape of beam portion 250*c* and anchor portion 250*b* (see FIG. 2C). In other embodiments, thermally conductive polymer 251 may not generally match the shape of beam portion 250*c* and anchor portion 250*b* (see FIG. 2C). In further embodiments beam portion 250*c* may not be encased in thermally conductive polymer while anchor portion 250*b* (see FIG. 2C) is encased. Some embodiments may be encased in thermally conductive polymer 251 that is less than 0.5 mm thick. Other embodiments may be encased in thermally conductive polymer 251 that is less than 1 mm thick. Further embodiments may be encased in thermally conductive polymer 251 that is less than 1.5 mm thick. Some embodiments may further have heat transfer features 253, 254 that may be completely made from thermally conductive polymer 251. Heat transfer features 253, 254 may be thermally coupled to shell 205 (see FIG. 2C) by, for example, an interference fit, insert molding, a bonding material or other technique. In some embodiments, contact 250 is less than 20 mm long from tip 250*a* to lead 210. In further embodiments, contact 250 is less than 30 mm long from tip 250*a* to lead 210. In still further embodiments, contact 250 is less than 40 mm long from tip 250*a* to lead 210.

Figure 4:
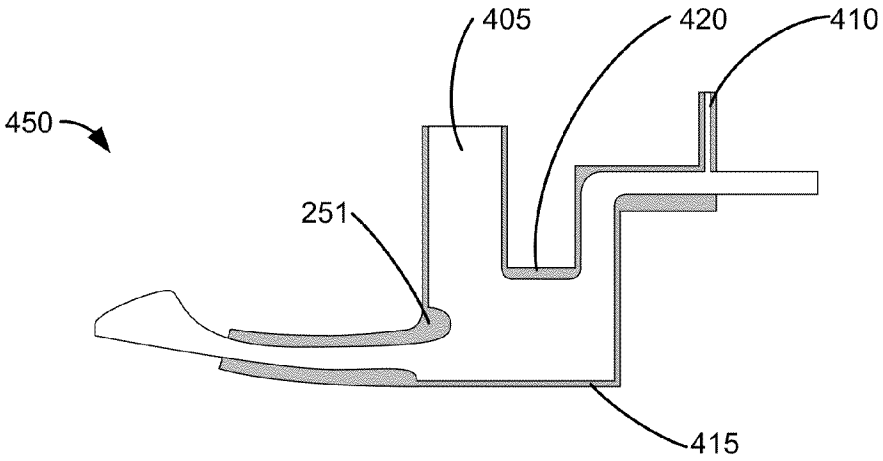
FIG. 4 is a diagram of an embodiment that illustrates a cross-sectional view of a contact comprising a thermally conductive polymer in accordance with an embodiment of the invention.

Some embodiments, such as contact 450 illustrated in FIG. 4, may have heat transfer features 405, 410 comprising, for instance, thermally conductive polymer 251. This may be particularly beneficial in embodiments where the thermal conductivity of contact 450 is greater than the thermal conductivity of thermally conductive polymer 251. Further embodiments may have other portions of contact 450 encapsulated in thermally conductive polymer 251 such as recess 420 and lower edge 415. Any area of contact 450 may be encapsulated or partially over-molded with thermally conductive polymer 251 to aid in the distribution of heat and conduction of heat to other components. For example, recess 420 may be substantially filled with thermally conductive polymer 251 and employed to transfer heat to housing 245 (see FIG. 2C) or shell 205. Further, in some embodiments lower edge 415 may be thermally coupled to shell 205 (see FIG. 2C) to transfer heat to the shell.

In some embodiments the thermally conductive polymer 251 may comprise a plastic resin, for example, liquid crystal polymer, polyamide, nylon, Polybutylene Terephthalate (PBT) or other polymer. In other embodiments, an elastomer may be used instead of a plastic resin to provide a more flexible, thermally conductive material. The embodiments that are thermally conductive and electrically insulative may add a filler to the resin such as, for example, ceramic particulates, silica, silicon-dioxide, silicon or other electrically insulative material. The embodiments that are thermally conductive and electrically conductive may add a filler to the resin such as, for example, metallic particulates, carbon particulates, graphite particulates, carbon nanotubes, metallic fibers or other electrically conductive material. Thus, some embodiments may employ an electrically insulative thermally conductive polymer 251 while other embodiments may employ an electrically conductive thermally conductive polymer. Either type of polymer may be employed without departing from the invention, however in some embodiments one type of polymer may be preferable over the other.

Figure 5:
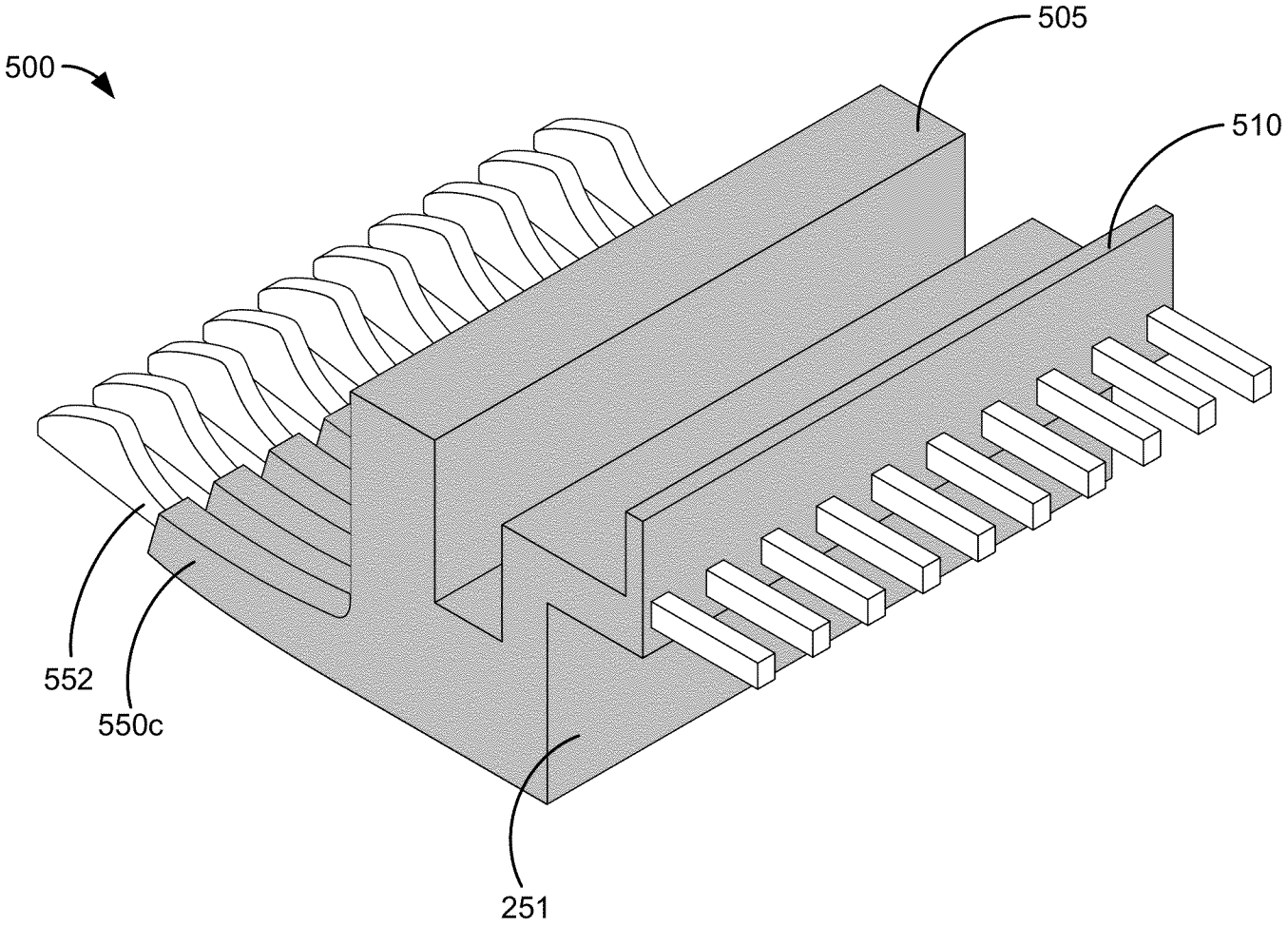
FIG. 5 is a diagram that illustrates a perspective view of a plurality of contacts co-molded with a thermally conductive polymer in accordance with an embodiment of the invention.

For example, FIG. 5 depicts an embodiment where a plurality of contacts 552 are encapsulated in a substantially unitary block of thermally conductive polymer 251 forming a ganged contact assembly 500. In this embodiment it may be beneficial to employ an electrically insulative thermally conductive polymer 251 to maintain electrical isolation between contacts 552. This embodiment may be particularly beneficial in spreading and dissipating heat generated in contacts 552 as the area of thermally conductive polymer 251 is much larger, resulting in a larger cross-sectional area to efficiently conduct heat. Further, in some embodiments, only a few contacts 552 may generate heat, thus the other areas of ganged contact assembly 500 can be used as a "heat sink" to dissipate the thermal energy. Ganged contact assembly 500 may also have one or more heat transfer features 505, 510 to aid in transferring heat to other components such as shell 205 (see FIG. 2C) or housing 245. Some embodiments of ganged contact assembly 500 may employ individually molded beam portions 550*c* to maintain individual contact flexibility and to improve the connector's ability to accommodate plugs with non-coplanar contacts. Other embodiments may not employ individually molded beam portions 550*c*.

Figure 6:
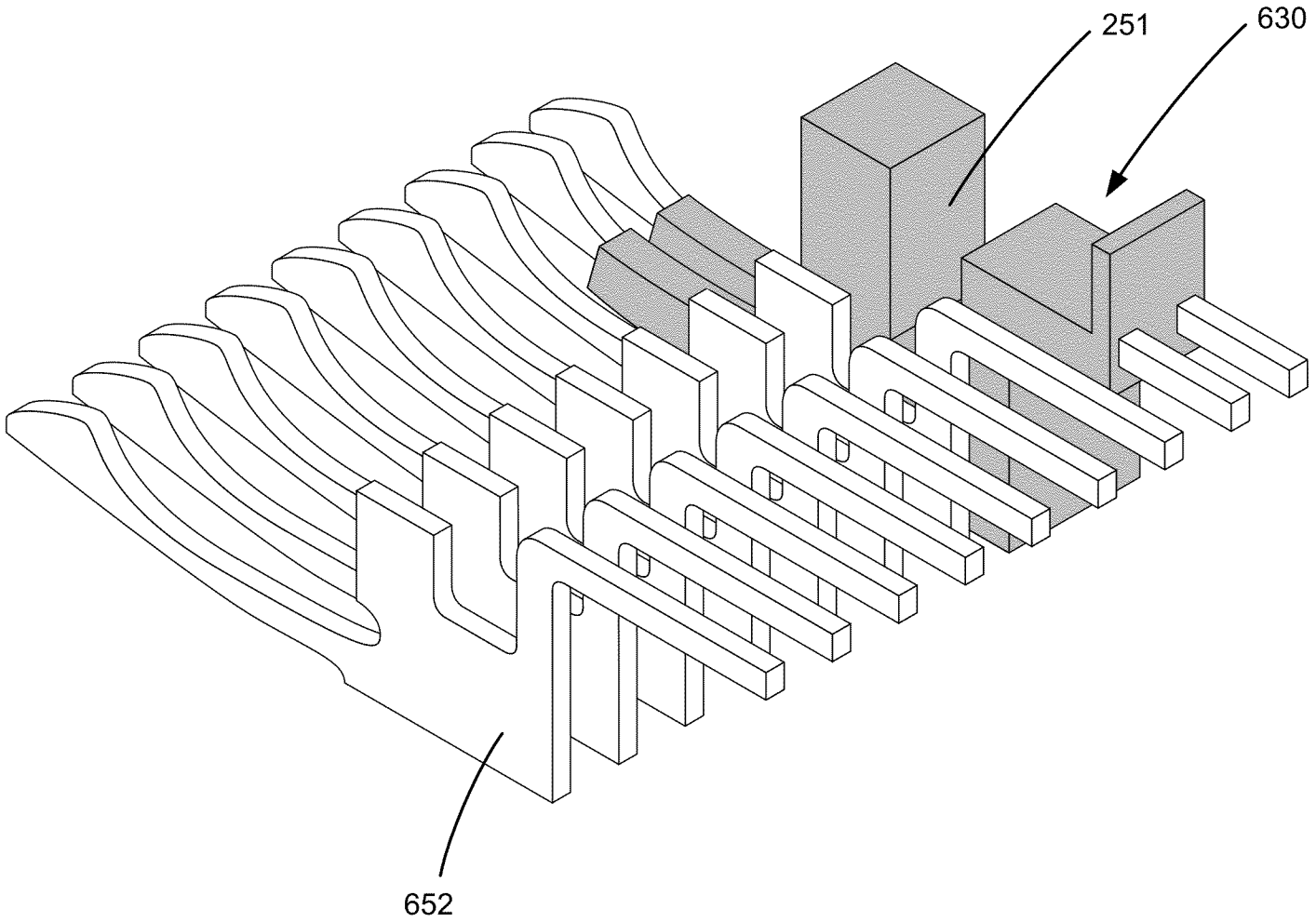
FIG. 6 is a diagram that illustrates a perspective view of a plurality of contacts co-molded adjacent to contacts with no molding in accordance with an embodiment of the invention.

Further embodiments, as depicted in FIG. 6, may employ two or more contacts 652 gang molded in a substantially unitary block 630 of thermally conductive polymer 251. In some embodiments, an electrically insulative thermally conductive polymer 251 may be employed, particularly when the gang molded contacts have different electrical potentials. However, in embodiments where contacts 652 have the same electrical potential, the contacts may be gang molded. Further embodiments may employ myriad combinations of molded and non-molded contacts. Some embodiments may employ a combination of gang molded and individually molded contacts while others may employ a combination of gang molded and non-molded contacts while still others may employ a combination of individually molded and non-molded contacts. Various combinations of molded, gang molded and non-molded contacts may be employed in a single connector assembly 200 (see FIG. 2) without departing from the invention.

Further, some embodiments may employ two or more separate gang molded groups of contacts. This may be particularly useful in high current applications where two or more contacts may be used for the positive terminal of a charging circuit and two or more contacts may be used for the negative terminal of a power circuit. In these embodiments, the contacts used for the positive terminal can be gang molded, as can the contacts used for the negative terminal. In some embodiments that employ electrically insulative thermally conductive polymer, the gang molded contacts for the negative terminal as well as the positive terminal can be thermally coupled to shell 205 (see FIG. 2C). However, in some embodiments where the thermally conductive polymer is also electrically conductive, the connector may be shorted if both the positive and negative potential contacts are connected to shell 205 (see FIG. 2C). Thus, in these embodiments, shell 205 (see FIG. 2C) may be split into two or more electrically isolated components such that both the positive and negative potential contacts may be coupled to the separate portions of the shell. Further, the portion of the shell that is coupled to the negative potential contacts may be connected to ground whereas the portion of the shell that is coupled to the positive potential contacts may be electrically isolated. This configuration may improve heat transfer from both the positive and negative potential contacts.

Figure 7:
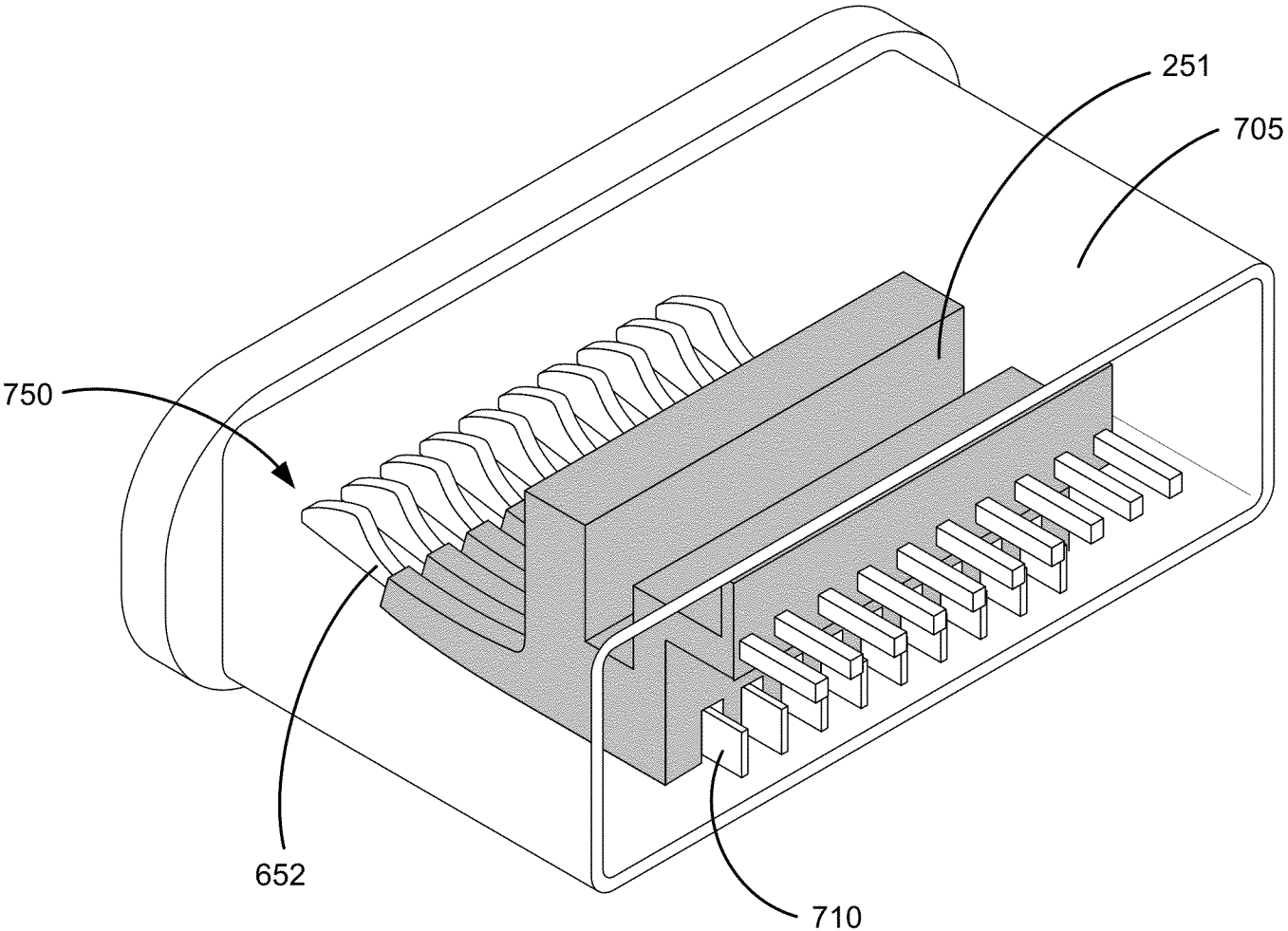
FIG. 7 is a diagram that illustrates a perspective view of a plurality of contacts co-molded with ground structures in accordance with an embodiment of the invention.

Some embodiments, as depicted in FIG. 7, may employ a plurality of contacts 652 that may be at least partially encapsulated with thermally conductive polymer 251, in combination with ground structures 710. Ground structures 710 may comprise an electrically conductive polymer extending from housing 705, between portions of adjacent contacts 750 in the plurality of contacts. In some embodiments, ground structures 710 can be substantially flat plates that are positioned adjacent to and/or sized to substantially cover (when viewed from the side) the anchor portion of one or more contacts 652.

In further embodiments, ground structures 710 may be substantially unitary with outer housing 705. In other embodiments, housing 705 and ground structures 710 may be injection molded at the same time. In some embodiments, ground structures 710 may comprise metal and be insert-molded during the injection molding of outer housing 705. In various embodiments, ground structures 710 may be placed between each and every contact 750 included in connector assembly 700 or may be placed between only certain contacts. In one embodiment, the contacts 750 and ground structures 710 are positioned in the following order: connector detect contact structure, ground structure, two signal contact structures, ground structure, two signal contact structures, ground structure, two signal contact structures, ground structure, two signal contact structures, ground structure, connector detect contact structure.

In some embodiments, ground structures 710 may be used to shield noisy signals from sensitive signals within the connector. For example, in some embodiments contacts 750 that are used to transmit power may be shielded by ground structures 710 from contacts 750 that are used to transmit data. In other embodiments, for example, contacts 750 may be used to transmit high-speed data using a matched impedance differential pair of conductors. In these embodiments, contacts 750 and ground structures 710 may be designed to minimize the discontinuity in impedance within connector assembly 700 to maximize the bandwidth of the differential pair. Similar uses may be employed for single ended high-speed conductors, such as, for example coaxial, microstrip, stripline and general transmission line designs, where ground structures 710 may be employed to minimize impedance disruption within connector assembly 700. In other embodiments, contacts 750 and ground structures 710 may be designed to reduce cross-talk between adjacent data signals. Other uses, benefits and features of disposing ground structures 710 between or adjacent to contacts 750 may be used without departing from the invention. Electromagnetic simulation using, for example, a full-field electromagnetic solver, may be employed and may result in optimized contacts 750 and ground structures 710 that look significantly different than depicted here. Such features and benefits thereof are fully contemplated herein and may be employed without departing from the invention.

Figure 8B:
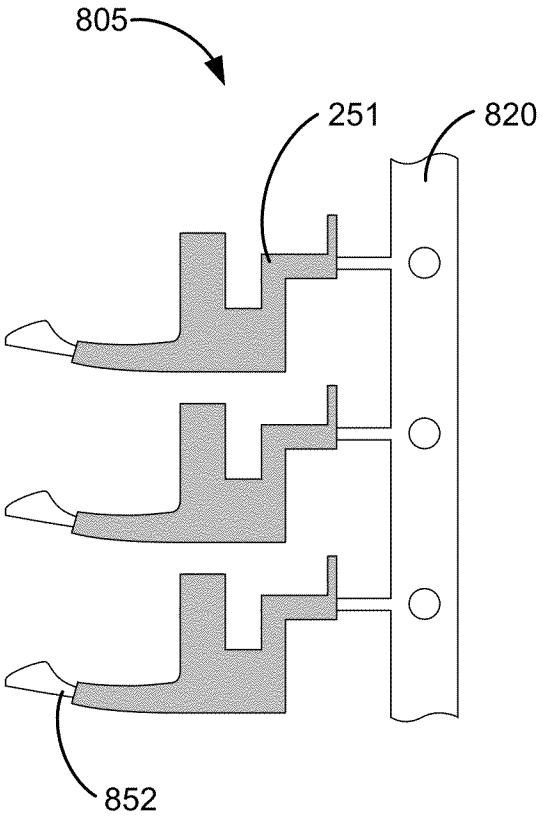
FIG. 8B is a diagram that illustrates a plan view of a leadframe strip with a plurality of contacts comprising thermally conductive polymer in accordance with an embodiment of the invention.
Figure 8A:
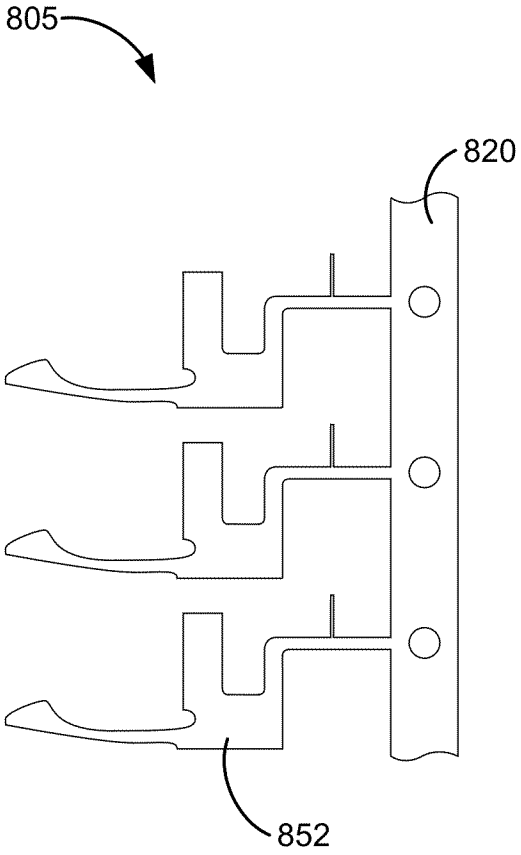
FIG. 8A is a diagram that illustrates a plan view of a leadframe strip with a plurality of contacts connected to it in accordance with an embodiment of the invention.

An exemplary manufacturing process for contacts 852 is illustrated in FIGS. 8A and 8B. FIG. 8A shows a portion of a leadframe strip 805 that has a plurality contacts 852 attached to rail 820. In some embodiments, leadframe strip 805 may be manufactured using, for example, stamping, a combination of stamping and forming, chemical etching, or other processes. Leadframe strip 805 may then be processed using, for example, an over-molding or insert-molding machine, as illustrated in FIG. 8B. In some embodiments, leadframe strip 805 may be placed in a die and thermally conductive polymer 251 may be injected around contacts 852. Other processes may be used to perform the same function. Contacts 850 may then be singulated from rail 820 and the contacts may then be integrated into a receptacle connector assembly.

Figure 9:
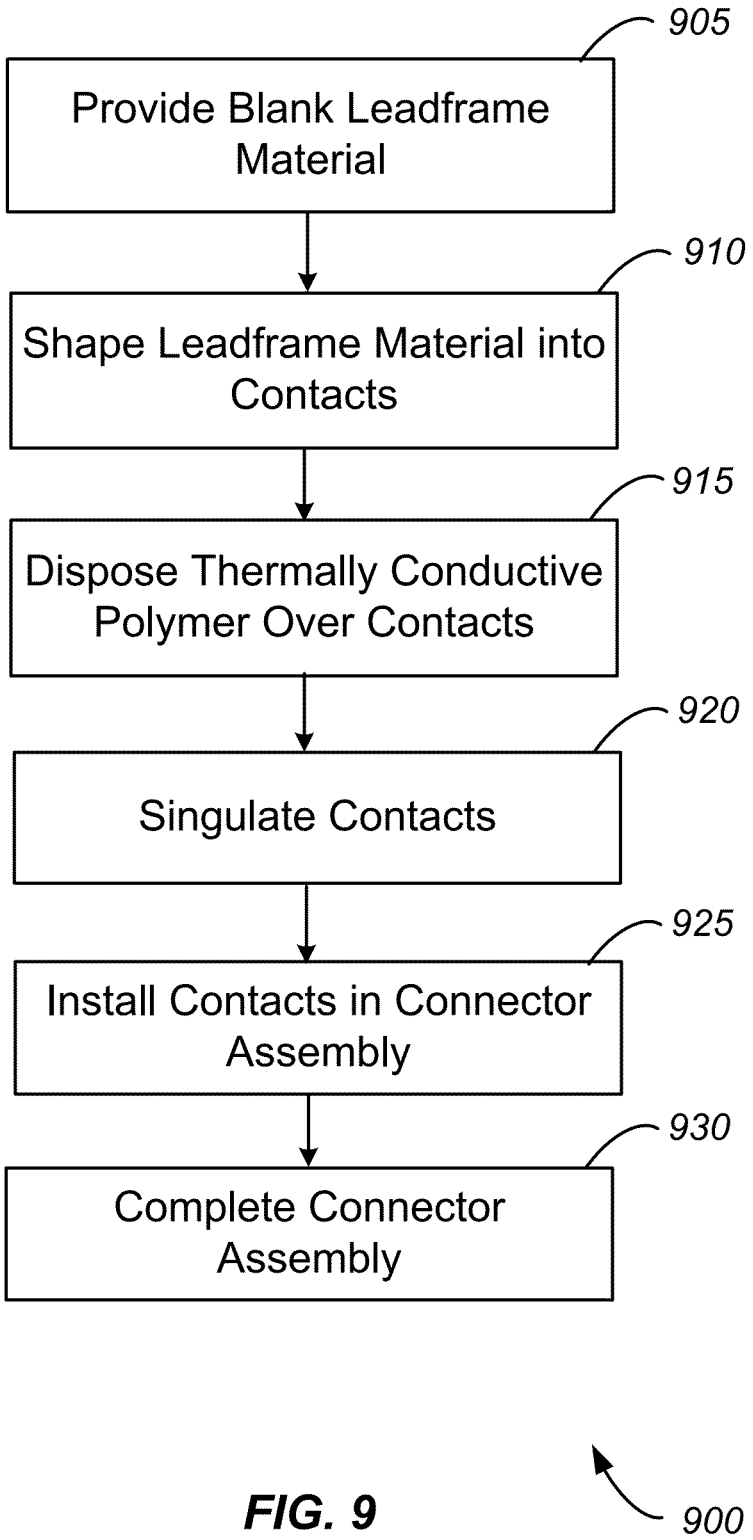
FIG. 9 is a process by which a connector with contacts comprising a thermally conductive polymer can be made in accordance with an embodiment of the invention.

An exemplary simplified process for manufacturing a connector assembly with contacts comprising thermally conductive polymer, in accordance with embodiments described herein, is depicted in FIG. 9. In step 905 a blank leadframe material may be provided. The leadframe material may comprise, for example, copper, brass, iron, phosphor-bronze, beryllium-copper, or other metallurgical alloys. In step 910 the leadframe material may be shaped into contacts. The contacts may have a tip for making contact with a mating plug, a beam that connects the tip to an anchor portion and a lead that extends from the anchor portion. The contacts can be made into myriad shapes without departing from the invention. In step 915 a thermally conductive polymer may be disposed over the contacts. The thermally conductive polymer may partially encapsulate one or more contacts. The polymer may be disposed, for example, by an insert molding machine, lamination, gluing, melting, or any other process. In step 920 the contacts may be singulated from the leadframe. In some embodiments a stamping process may be used to perform this operation. In step 925 the contacts may be installed into a connector assembly. In some embodiments the contacts are inserted into a plastic housing, however other methods may be employed. In step 930 the connector may be completed, for example, by adding a rear enclosure and a shell. In further embodiments portions of the contacts may be thermally coupled to the housing or the shell.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An electrical receptacle connector comprising:

a body having an opening that communicates with a cavity;

a plurality of contacts, each of the plurality of contacts having a tip positioned within the cavity and arranged to make an electrical connection with an electrical contact in a mating connector, an anchor portion that anchors the contacts to the body and a beam portion that extends between the tip and the anchor; and wherein at least one of the plurality of contacts is partially encased in a thermally conductive polymer such that the tip of the at least one of the plurality of contact is exposed.

2. The electrical receptacle connector set forth in claim 1 wherein the body further includes a metal shell and insulative housing within the shell.

3. The electrical receptacle connector set forth in claim 1 wherein the thermally conductive polymer extends along the beam portion and covers the anchor portion.

4. The electrical receptacle connector set forth in claim 1 wherein each of the plurality of contacts further includes a lead that extends out of the body from a side of the anchor portion opposite the beam portion.

5. The electrical receptacle connector set forth in claim 1 wherein the thermally conductive polymer comprises a polymer filled with metallic particles.

6. The electrical receptacle connector set forth in claim 1 wherein the thermally conductive polymer comprises a polymer filled with ceramic particles.

7. The electrical receptacle connector set forth in claim 1 wherein the plurality of contacts are arranged in a single row with the tip of each contact at the same depth within the insulative housing.

8. The electrical receptacle connector set forth in claim 1 wherein two or more of the plurality of contacts are molded in a substantially unitary block of thermally conductive polymer.

9. The electrical receptacle connector set forth in claim 8 wherein each of the two or more of the plurality of contacts molded in a substantially unitary block of thermally conductive polymer have individually molded beam portions.

10. An electrical receptacle connector comprising:

a connector assembly having a receiving face with a front opening to receive a plug portion of a mating plug connector and a rear face disposed opposite of the receiving face;

a housing that extends between the receiving face and the rear face, the housing defining a cavity that communicates with the front opening;

a plurality of contacts, each of the plurality of contacts having an exposed portion including a tip positioned within the cavity; and wherein at least one of the plurality of contacts has an encased portion comprising a thermally conductive polymer.

11. The electrical receptacle connector set forth in claim 10 wherein the plurality of contacts each has an anchor portion and a beam portion that connects the tip to the anchor portion; and a portion of the beam portion comprises a thermally conductive polymer.

12. The electrical receptacle connector set forth in claim 10, further comprising a shell disposed at least partially around an exterior of the housing;

wherein at least one of the plurality of contacts has a heat transfer feature comprising a thermally conductive polymer; and wherein the heat transfer feature is thermally coupled to the shell.

13. The electrical receptacle connector set forth in claim 10 wherein more than one of the plurality of contacts are partially encapsulated within a substantially unitary block of thermally conductive polymer.

14. The electrical receptacle connector set forth in claim 13 wherein a ground structure comprising an electrically conductive polymer extends from the housing between portions of adjacent contacts in the plurality of contacts.

15. The electrical receptacle connector set forth in claim 14 wherein the ground structure is connected to ground.

16. The electrical receptacle connector set forth in claim 10 wherein the thermally conductive polymer is also electrically conductive.

17. The electrical receptacle connector set forth in claim 10 wherein a ground structure, comprising an electrically conductive polymer, extends from the housing between portions of adjacent contacts in the plurality of contacts.

18. The electrical receptacle connection set forth in claim 13, wherein each of the more than one of the plurality of contacts partially encapsulated within the substantially unitary block of thermally conductive polymer have individually molded beam portions.

19. The electrical receptacle connector set forth in claim 10, wherein the thermally conductive polymer comprises a polymer filled with metallic particles.

20. The electrical receptacle connector set forth in claim 10, wherein the thermally conductive polymer comprises a polymer filled with ceramic particles.

* * * * *